United States Patent [19]

Polly, Jr.

[11] 4,131,102

[45] Dec. 26, 1978

[54] BALL THROWING SLING

[76] Inventor: John R. Polly, Jr., M.P.O. Box 5884, Oxnard, Calif. 93031

[21] Appl. No.: 816,679

[22] Filed: Jul. 18, 1977

[51] Int. Cl.[2] ..... A41B 3/00

[52] U.S. Cl. ..... 124/5; 2/159; 2/16; 124/41 R

[58] Field of Search ..... 124/41 R, 5, 4; 2/159, 2/160, 161 A, 163, 16, 21; 273/96; 280/637

[56] References Cited

U.S. PATENT DOCUMENTS

| | | | |
|---|---|---|---|
| 1,419,682 | 6/1922 | Miles | 124/41 R |
| 2,644,441 | 7/1953 | Simko | 124/5 |
| 3,408,657 | 11/1968 | Gallagher | 2/159 |
| 3,843,126 | 10/1974 | Bandy | 2/16 X |
| 3,931,656 | 1/1976 | Thomson | 280/637 X |
| 3,983,860 | 10/1976 | Bolton | 124/20 R |

*Primary Examiner*—Richard C. Pinkham
*Assistant Examiner*—William R. Browne
*Attorney, Agent, or Firm*—Matthew L. Ajeman

[57] ABSTRACT

A sling having a longitudinally extending, flexible element attached to a finger of a glove to be worn by one using the sling for facilitating control of an object being thrown by the sling, and for protecting the user's hand. Inserted into the extent of the flexible element, substantially at the midpoint of such extent, is a pocket provided with a centrally disposed, elongated hole arranged for receiving a portion of an object to be thrown, with crossed straps extending across the hole for retaining the object to be thrown within the pocket of the sling.

7 Claims, 4 Drawing Figures

BALL THROWING SLING

BACKGROUND OF THE INVENTION

1. Field of the Invention

This invention relates generally to the throwing of objects by hand, and particularly to improvements in the construction of a sling.

2. Description of the Prior Art

The sling is an ancient device employed even in Biblical times, although in a slightly different manner than modern slings are used, to throw a projectile with great force and/or for a great distance. A modern application of the sling is to throw a ball to be retrieved by a dog or other animal.

One example of a modern sling is found in U.S. Pat. No. 2,644,441, issued July 7, 1953 to A. S. Simko, which discloses a ball-throwing sling having a ball-retaining pocket provided with a pair of opposed openings, and with a pair of straps, one of which straps being provided with a finger receiving loop in an end thereof spaced from the pocket. The other of the straps is provided at an end thereof spaced from the pocket with a finger engaging tab. The finger retaining loop is intended to retain the sling on a thrower's finger. In a similar manner, U.S. Pat. No. 1,419,682, issued June 13, 1922 to G. B. Miles, discloses a sling having a finger loop and knot terminating respective straps extending from a pocket of the sling.

U.S. Pat. No. 1,776,435, issued Sept. 23, 1930 to H. C. Isbell, discloses a sling provided with an element which forms a loop disposed for receiving a finger of one's throwing hand. In addition, U.S. Pat. No. 381,732, issued Apr. 24, 1888 to A. H. Walker, discloses the need for good control of an arm actuated projecting device.

One basic disadvantage of the known slings is that the conventionally provided finger loop makes the thrower's finger sore, while the tab at the other end of the sling forms another disadvantage inasmuch as it tears at the flesh of the hand as the tab is released. Further, the saliva imparted to the ball, or similar object, by a dog, and the like, makes the ball very hard to handle, and consequently makes the thrower's hand slippery so as to hinder control of the free end of the sling. Still further, the known slings generally are provided with a pocket constructed in such a manner, such as by rivets, that the pocket will not lie flat, and consequently the pocket grabs at the ball, or other object being thrown, as same is released, thus further hindering control of the throwing operation.

SUMMARY OF THE INVENTION

It is an object of the present invention to provide a sling which can be used repeatedly without harm to a finger on the thrower's hand.

It is another object of the present invention to provide a sling which eliminates lack of control of the sling due to saliva, or a similar foreign substance, being transferred to a thrower's hand by an object being thrown.

It is yet another object of the present invention to provide a sling having a pocket which facilitates picking-up of a ball or other object to be thrown, and prevents grabbing of the ball by the pocket as the ball is being released from the pocket of the sling.

These and other objects are achieved according to the present invention by providing a sling having: a glove; a longitudinally extending, flexible element connected to the glove; and a pocket inserted into the flexible element intermediate the longitudinal extent thereof for receiving an object to be thrown.

The glove preferable includes a hand portion having at least one finger receiving part; the flexible element having one longitudinal end affixed to the finger receiving part of the glove, adjacent the hand portion thereof. The finger receiving part of the glove has a circumference about which the flexible element can be wrapped and attached to the finger receiving portion at spaced points by a suitable, known filiment, such as one constructed from a synthetic resin.

The flexible element itself is preferable formed in two portions, with each of the portions of the flexible element being attached to the pocket in spaced relation with respect to one another.

The pocket includes a planar body provided with an elongated hole arranged for receiving a spherical object, such as a ball, and straps mounted on the body and disposed extending across the hole, somewhat loosely, for retaining the ball in the pocket. The hole is advantageously substantially in the form of an ellipse, with a longest axis of the ellipse being arranged extending between points of attachment of the two portions of the flexible element to the body of the pocket. The straps include a longitudinally extending first strap and a longitudinally extending second strap, each constructed from a flexible material and arranged extending longitudinally perpendicularly to one another, with the first strap having a longitudinal extent greater than the longitudinal extent of the second strap and being arranged extending parallel to the longest axis of the ellipse.

DESCRIPTION OF THE PREFERRED EMBODIMENT

Figure 1:
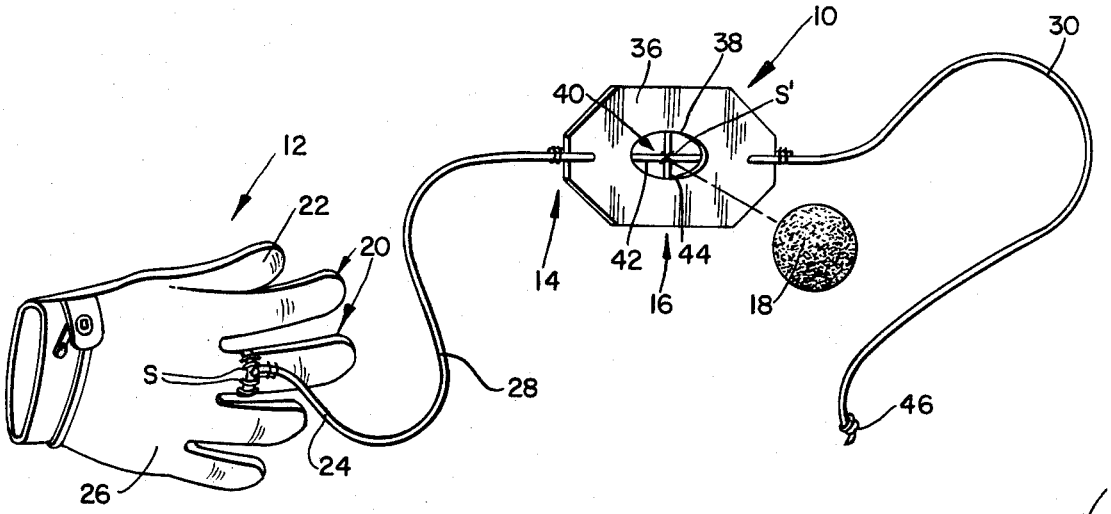
FIG. 1 is a schematic, perspective view showing a sling according to the present invention, with the relationship of a ball to the pocket of the sling being indicated.

Referring now more particularly to the figures of the drawing, a sling 10 according to the invention includes a glove 12 to which is attached an end of a longitudinally extending, flexible element 14. A pocket 16 is inserted into the flexible element 14 intermediate of the longitudinal extent thereof, for receiving an object 16, such as the illustrated ball, to be thrown by sling 10.

Glove 12 includes a plurality of finger portions 20 and a thumb portion 22, with the flexible element 14 having one longitudinal end 24 affixed to one of the finger portions 20 of glove 12 adjacent to a hand portion 26 of the glove 12. Finger receiving portions 20 of glove 12 are each provided with a circumference, and the end 24 of flexible element 14 is wrapped around the circumference of an associated one of the finger portions 20 and attached thereto at a plurality of points by suitable stitching formed with a suitable filament, such as a nylon fishing line.

Flexible element 14 is formed in two portions 28 and 30, each of which portions 28, 30 is attached to pocket 16 in spaced relation to the other of the portions 30, 28. More specifically, the end of each of the portions 28, 30 which is attached to pocket 16 is formed into a loop 32, 34, respectively, which passes through an associated eye provided in the pocket 16, and is attached to itself for retention if the associated eye provided in the pocket 16.

Pocket 16 includes a planar body 36 provided centrally thereof with an elongated hole 38 arranged for receiving a spherical object 18. A strap arrangement 40 is mounted on body 36 and extends across hole 38 for retaining the object 18 in the pocket 16.

The hole 38 is substantially in the form of an ellipse, with a long axis of the ellipse being arranged extending between the eyes forming the points of attachment of the portions 28, 30 of the flexible element 14 to body 36 of pocket 16.

Strap arrangement 40 includes a longitudinally extending first strap 42 and a longitudinally extending second strap 44, each constructed from a flexible material and having longitudinally spaced ends affixed to body 36 of pocket 16, and arranged extending longitudinally perpendicularly with respect to one another. First strap 42 has a longitudinal extent which is greater than the longitudinal extent of the second strap 44 so that the straps will match with the elliptical configuration of hole 38.

Straps 42 and 44 cross one another within hole 38, and are attached to one another as by suitable stitching S'. The length of straps 42, 44 is such that they curve away from the plane of body 36 of pocket 16, and permit part of a spherical object 18 to extend through hole 38.

The various elements of a sling 10 can be constructed from suitable materials, such as natural or simulated leather.

Figure 2:
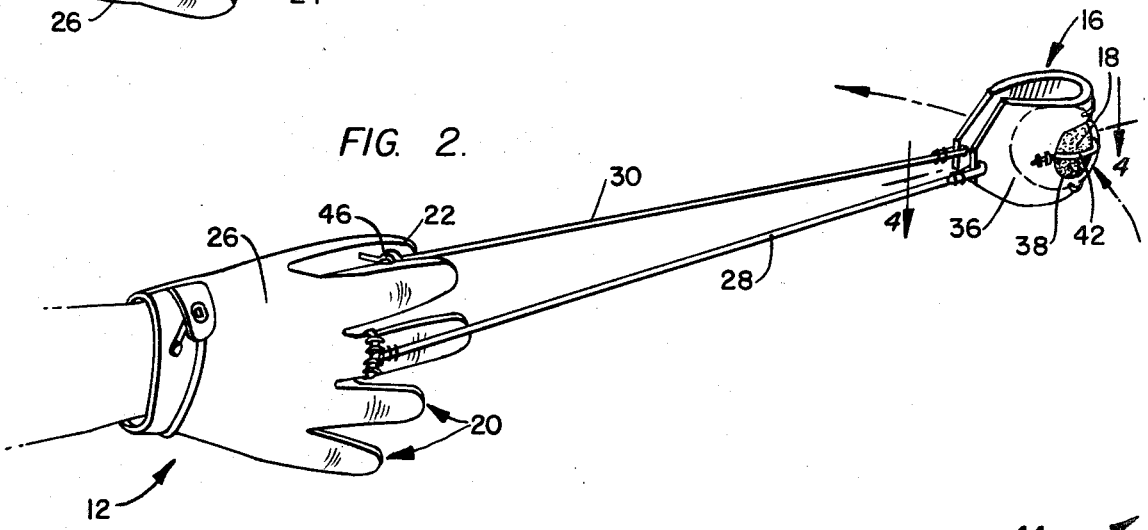
FIG. 2 is a schematic, perspective view, similar to FIG. 1, but showing the sling with a ball disposed in the pocket thereof and ready for release by a person operating the sling.
Figure 3:
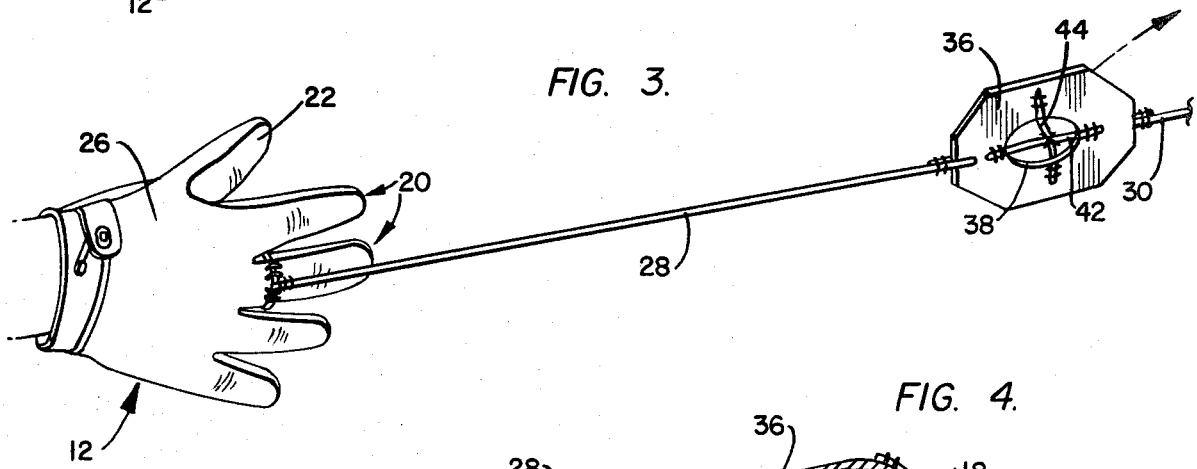
FIG. 3 is a schematic, perspective view, similar to FIGS. 1 and 2, but showing the sling after release of the object being thrown.
Figure 4:
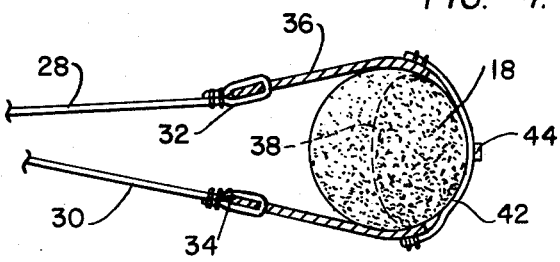
FIG. 4 is an enlarged, fragmentary, sectional view taken generally along the line 4—4 of FIG. 2.

In operation, it will be appreciated that a sling according to the invention can have knotted end 46 gripped between the thumb 22 and forefinger of the finger portions 20 of glove 26, and an object 18, such as the illustrated ball, inserted into hole 38 provided in body 36 of pocket 16. This arrangement is shown in FIG. 2. Subsequently, a person using the sling can throw the sling, or more specifically pocket 16, outwardly in order to release object 18, and releasing end 46 in the process, as can be seen in FIG. 3. Attachment of the flexible element 14, or more specifically the portion 28 thereof, to one of finger portions 20 of glove 12 eliminates wear and tear on the hand of the operator, with the glove also protecting the operators hand from saliva and other foreign matter which may be picked-up on object 18 when same is retrieved by a dog (not shown), and the like, for being thrown again.

As can be readily understood from the above description and from the drawing, a sling according to the present invention permits an object to be throw an object, such as a ball, repeatedly over a substantial length of time without the finger on the thrower's hand to which the sling is attached becoming sore and raw, and without either hand of the thrower becoming contaminated with saliva, or a similar foreign substance, while picking-up the ball and placing same back into the pocket of the sling, since the latter operation can be performed entirely by the gloved hand. That is, the gloved hand can pick up the ball and place it in the pocket while the pocket is being positioned by the thrower's other hand, for example.

It is to be understood that the above description of the present invention is capable of various changes, modifications and adaptions, and such are intended to be included within the meaning and range of equivalents of the following claims.

I claim:

1. A sling, comprising, in combination:

(a) a glove;

(b) a longitudinally extending, flexible element having a pair of longitudinally spaced ends, and being attached to the glove at one of the ends; and (c) pocket means inserted into the flexible element intermediate the longitudinal extent thereof for receiving an object to be thrown, the glove including a hand portion and a finger portion, the flexible element having the one of the longitudinal ends affixed to the finger receiving portion of the glove.

2. A structure as defined in claim 1, wherein the finger receiving portion of the glove has a circumference, with the flexible element being wrapped around the circumference of the finger receiving portion adjacent the hand portion and attached to the finger receiving portion at a plurality of spaced points.

3. A structure as defined in claim 2, wherein the flexible element is formed in two portions, each of the portions being attached to the pocket means in spaced relation to the other of the portions of the flexible element.

4. A structure as defined in claim 3, wherein the pocket means includes a planar body provided centrally thereof with an elongated hole arranged for receiving a spherical object, and strap means mounted on the body and arranged extending across the hole for retaining the object in the pocket means.

5. A structure as defined in claim 4, wherein the hole is substantially in the form of an ellipse having a long axis arranged between points of attachment of the portions of the flexible element to the body of the pocket means.

6. A structure as defined in claim 5, wherein the strap means includes a longitudinally extending first strap and a longitudinally extending second strap, with each strap being constructed from a flexible material, having longitudinally spaced ends affixed to the body of the pocket means, and being arranged extending longitudinally perpendicularly to one another, with the first strap having a longitudinal extent greater than the longitudinal extent of the second strap, and the first strap and second strap being longer than the corresponding dimension of the hole for permitting a spherical object to be partly received in the hole.

7. A structure as defined in claim 6, wherein the first strap and second strap cross one another within the hole, and are attached to one another where they cross.

* * * * *